US008007076B2

(12) United States Patent
Ono

(10) Patent No.: US 8,007,076 B2
(45) Date of Patent: Aug. 30, 2011

(54) INK JET HEAD AND PRODUCTION PROCESS THEREOF

(75) Inventor: Takayuki Ono, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 403 days.

(21) Appl. No.: 12/140,646

(22) Filed: Jun. 17, 2008

(65) Prior Publication Data

US 2009/0002453 A1 Jan. 1, 2009

(30) Foreign Application Priority Data

Jun. 21, 2007 (JP) ..... 2007-163706

(51) Int. Cl.
*B41J 2/05* (2006.01)

(52) U.S. Cl. ..... 347/58

(58) Field of Classification Search ..... 347/48, 347/50, 86, 55–58; 29/25.35
See application file for complete search history.

(56) References Cited

U.S. PATENT DOCUMENTS

| | | | | |
|---|---|---|---|---|
| 7,066,573 | B2 * | 6/2006 | Silverbrook et al. | 347/49 |
| 7,249,826 | B2 * | 7/2007 | Birkmeyer et al. | 347/68 |
| 7,434,914 | B2 * | 10/2008 | Ito | 347/50 |
| 2007/0006459 | A1 | 1/2007 | Ono et al. | |

FOREIGN PATENT DOCUMENTS

JP 2005-41158 2/2005

* cited by examiner

*Primary Examiner* — Lamson D Nguyen
(74) *Attorney, Agent, or Firm* — Fitzpatrick, Cella, Harper & Scinto

(57) ABSTRACT

An ink jet head is constituted by a recording element substrate comprising an energy generating element; and an electric wiring member on which a plurality of flying leads electrically connected to said recording element substrate by thermocompression bonding through gang bonding is arranged in parallel. The ink jet head further includes a plurality of thermocompression bonding portions, formed on the plurality of flying leads by the thermocompression bonding, including thermocompression bonding portions formed on at least both end flying leads with respect to an arrangement direction of the plurality of flying leads. The thermocompression bonding portions formed on the above-described at least both end flying leads are offset toward a center of the plurality of flying leads with respect to the arrangement direction.

4 Claims, 8 Drawing Sheets

INK JET HEAD AND PRODUCTION PROCESS THEREOF

FIELD OF THE INVENTION AND RELATED ART

The present invention relates to an ink jet (printing or recording) head and a process for producing the ink jet head.

Electrical connection between a recording element substrate of an ink jet head and an electric wiring member having flying leads has been conventionally performed generally by a single-point bonding method and a gang bonding method.

The single-point bonding method requires preparing operations such as formation of state bumps and leveling before final bonding and is liable to provide a low bonding strength since the final bonding is performed by using ultrasonic wave. Further, the bonding is performed while positions of flying leads with respect to X direction and Y direction are determined one by one, so that a device configuration is complicated and a processing tact time for bonding is increased.

On the other hand, in the gang bonding method, after a connecting pad on a recording element substrate is plated with gold or gold-tin alloy, flying leads of an electric wiring member are bonding to the connecting pad simultaneously by thermocompression bonding. For that reason, the gang bonding method has the advantage that the electrical connecting pad on the recording element substrate is less stressed to increase a bonding strength. Further, all the flying leads are bonded simultaneously with a wide bonding tool, so that positioning of the flying leads with respect to a left-right direction (arrangement direction) is relatively simple. For that reason, a device configuration for bonding is also relatively simple, so that it is possible to ensure the substantially same processing tact time irrespective of the number of the flying leads.

In the gang bonding method, a shape of an electrical connecting portion between the electrical connecting pad on the recording element substrate and the flying leads of the electric wiring member is, e.g., as shown in FIGS. 11A and 11B, as described in Japanese Laid-Open Patent Application No. 2005-41158.

Referring to FIG. 11B showing a front view, when the bonding by the gang bonding method is performed, first, flying leads 101 of an electric wiring member 102 are aligned with electrical connecting pads 104 on a recording element substrate 103. Then, bonding is performed with a bonding tool (not shown) having a width more than a full width of the plurality of arranged flying leads. As a result, a thermocompression bonding portion 105 is formed on each of the flying leads in the full width by the thermocompression bonding with the bonding tool.

The thermocompression bonding portion 105 of the flying lead 101 is, as shown in FIG. 11A, dented by impact during the thermocompression bonding with the bonding tool. That is, a local portion of the flying lead subjected to the thermocompression bonding is dented in the full width of the flying lead. Due to this dent, in a conventional electrical connecting method, when flying leads of an electric wiring member are electrically connected to a recording element substrate by the gang bonding method, there arises the following problem.

During, e.g., an operation of ink jet head, when some force is externally applied to the electric wiring member having the flying leads, stress is imposed on the flying leads fixed on the recording element substrate. This stress concentrates at a thermocompression bonding portion as a fixing portion with respect to the substrate, so that when a degree of the stress concentration exceeds a limit, the flying lead causes breaking thereof at the thermocompression bonding portion in some cases.

Particularly, in the case where a force is applied to the electric wiring member 102 having the flying leads 101 (FIG. 12A) in an in-plane rotational direction θ (FIG. 12B), stress applied to flying leads 101 located at both ends with respect to an arrangement direction of the flying leads 101 is greatest. As a result, the stress concentrates at thermocompression bonding portions of the both end flying leads 101 with respect to the arrangement direction, so that the flying leads 101 can be broken at the thermocompression bonding portions thereof (FIGS. 12C and 12D).

SUMMARY OF THE INVENTION

A principal object of the present invention is to provide an ink jet head capable of enhancing reliability of a connecting portion between an electrical connecting pad of a substrate and a flying lead.

Another object of the present invention is to provide a process for producing the ink jet head.

According to an aspect of the present invention, there is provided an ink jet head comprising:

a recording element substrate comprising an energy generating element; and an electric wiring member on which a plurality of flying leads electrically connected to the recording element substrate by thermocompression bonding through gang bonding is arranged in parallel, wherein the ink jet head comprises a plurality of thermocompression bonding portions, formed on the plurality of flying leads by the thermocompression bonding, including thermocompression bonding portions formed on at least both end flying leads with respect to an arrangement direction of the plurality of flying leads, and wherein the thermocompression bonding portions formed on the above-described at least both end flying leads are offset toward a center of the plurality of flying leads with respect to the arrangement direction.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Embodiments of the present invention will be described with reference to the drawings.

First Embodiment

Figure 1:
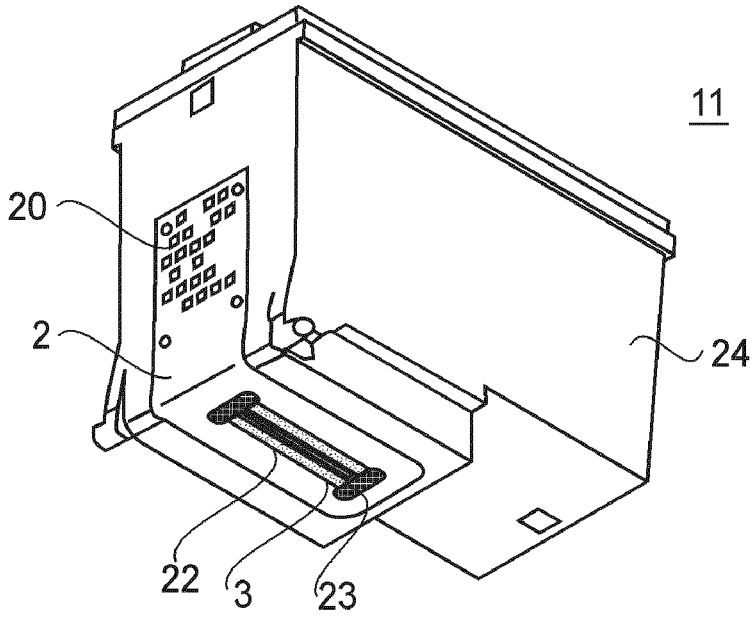
FIG. 1 is a schematic perspective view showing an example of an ink jet head of First Embodiment according to the present invention.

FIG. 1 is a perspective view showing an example of an ink jet head of this embodiment. An ink jet head 11 employs electrothermal transducer elements (energy generating elements) each for generating heat energy for causing film boiling with respect to ink depending on an electric signal.

Figure 2:
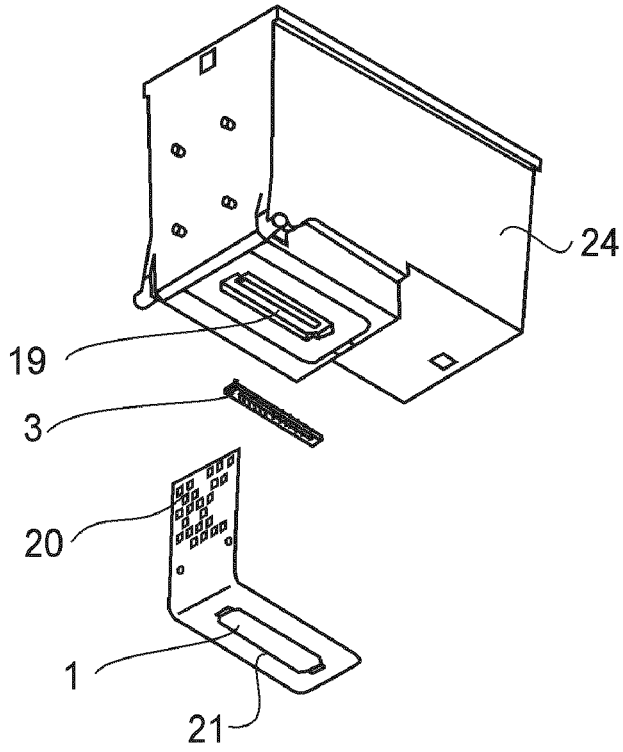
FIG. 2 is an exploded perspective view of the ink jet head shown in FIG. 1.

FIG. 2 is an exploded perspective view of the ink jet head shown in FIG. 1. The ink jet head 11 includes a recording element substrate 3, an electric wiring member 2 having flying leads 1, and an ink retaining member 24.

Figure 3:
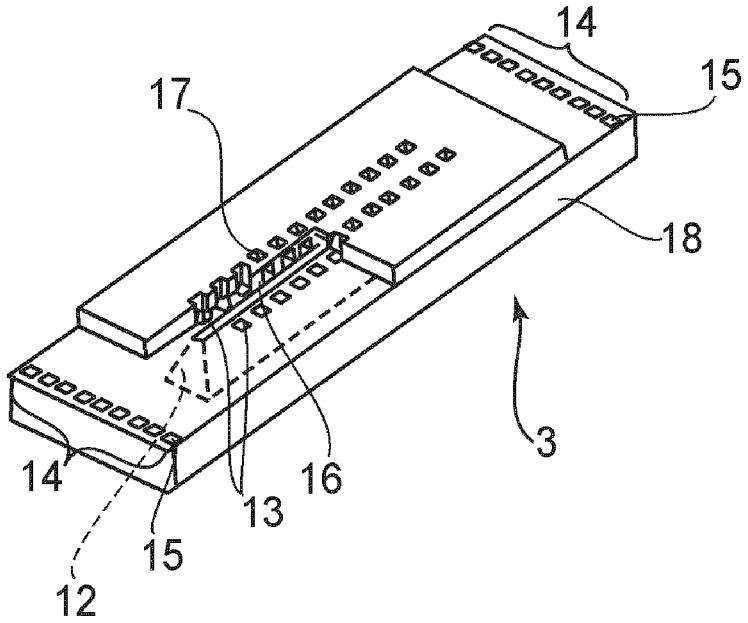
FIG. 3 is a schematic perspective view showing a recording element substrate in a partly cutaway manner.

FIG. 3 is a perspective view showing the recording element substrate 3 in a partly cutaway manner.

The recording element substrate 3 may be prepared by forming an elongated groove-like ink supply port (through hole) 12 as an ink flow passage on, e.g., a 0.5-1.0 mm thick silicon substrate 18 by using anisotropic etching utilizing crystal orientation or sandblast.

The silicon substrate 18 is provided with electrothermal transducer elements (energy generating elements) 13 arranged in two lines so as to sandwich the ink supply port 12 and on which unshown electric wiring of Al (aluminum) or the like for supplying electric power (energy) to the energy generating elements 13 is formed.

Ink supplied from the ink supply port 12 of the recording element substrate 3 is ejected from ejection outlets 17 provided opposite to the energy generating elements 13, respectively, by a pressure of bubbles generated in ink droplets by heat generation of the respective energy generating elements 13.

Figure 4:
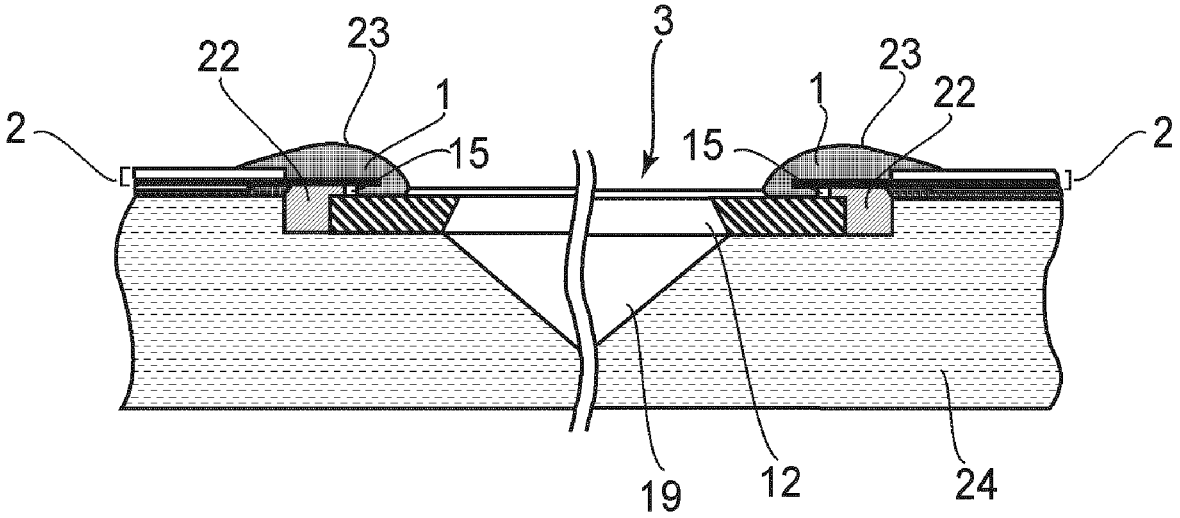
FIG. 4 is a schematic sectional view showing a connecting (bonding) portion between the recording element substrate and an electric wiring member having flying leads.

FIG. 4 is a sectional view for schematically illustrating a connecting portion between the recording element substrate 3 and the electric wiring member 2 having the flying leads 1.

The electric wiring member 2 having the flying leads 1 forms an electric signal path through which an electric signal for ejecting ink is to be applied to the recording element substrate 3. the electric wiring member 2 is prepared by forming a copper foil wiring pattern on a base material of polyimide. Further, the electric wiring member is provided with an opening 21. In the neighborhood of the opening 21, the flying leads 1 to be connected to an electrical connecting portion 14 of the recording element substrate 3 are provided.

Further, to the electric wiring member 2, external signal input terminals 20 for receiving an electric signal from an apparatus main assembly are provided and these external signal input terminals 20 are connected to the flying leads 1 through a continuous copper foil wiring pattern.

Electrical connection between the electric wiring member 2 having the flying leads 1 and the recording element substrate 3 is performed in, e.g., the following manner.

That is, bumps 15 formed at the electrical connecting terminal portion 14 of the recording element substrate 3 and the flying leads 1 of the electric wiring member 2 are positioned and bonded to each other so as to satisfy a predetermined positional relationship, thus establishing the electrical connection.

Referring again to FIGS. 1 and 2, the ink retaining member 24 is, e.g., prepared by resin molding. At downstream portion of the ink flow passage provided to the ink retaining member 24, an ink supply passage 19 for supplying ink to the recording element substrate 3 is formed. Then, the recording element substrate 3 is adhesively fixed to the ink retaining member 24 so that the ink supply port 12 of the recording element substrate 3 can communicate with the ink supply passage 19 of the ink retaining member 24.

Further, at a flat surface around an adhesive surface of the recording element substrate 3, a part of a back surface of the electric wiring member 2 having the flying leads 1 is adhesively fixed by an adhesive material.

The electrical connecting portion between the recording element substrate 3 and the electric wiring member 2 is sealed up with a first sealant 22 and a second sealant 23 (FIG. 1 and FIG. 4). The first sealant 22 seals a back-surface side of the connecting portion between the flying leads 1 of the electric wiring member 2 and the bumps 15 of the recording element substrate 3 and seals an outer peripheral portion of the recording element substrate 3. The second sealant 23 seals a front-surface side of the connecting portion. As a result, the electrical connecting portion is protected from corrosion by ink and external impact.

Further, an unfixed portion of the electric wiring member 2 having the flying leads 1 is bent and fixed on a side surface of the ink retaining member 24 substantially perpendicular to the adhesive surface of the recording element substrate 3 with respect to the ink retaining member 24 by thermal calking, adhesive bonding, etc.

Figure 5:
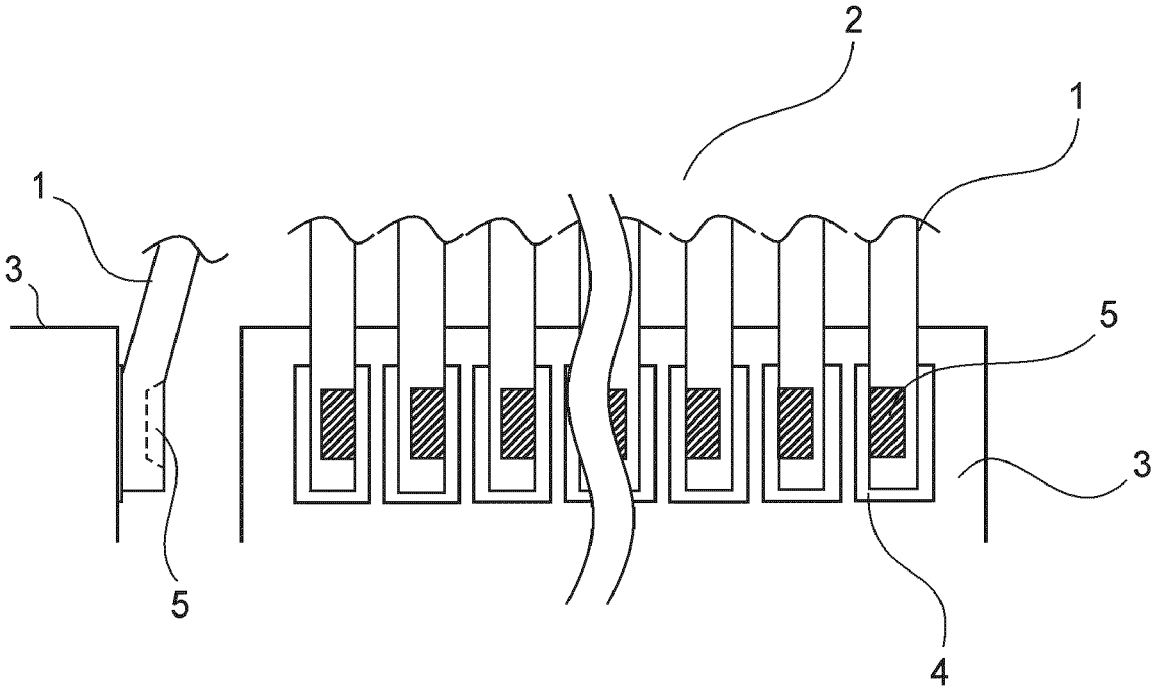
FIG. 5 is a schematic view showing an electrical connecting portion between electrical connecting pads on the recording element substrate and the flying leads of the electric wiring member.

FIG. 5 is a schematic view showing the electrical connecting portion between the electrical connecting pads 4 on the recording element substrate 3 and the flying leads 1 of the electric wiring member 2 in this embodiment.

Figure 6A:
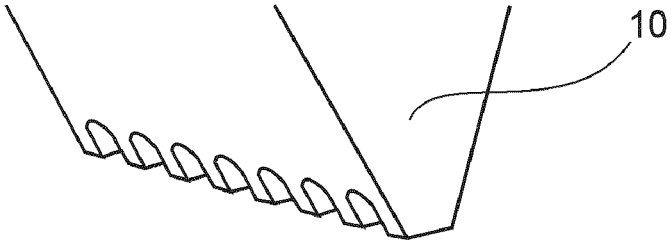
FIGS. 6A to 6D are schematic views for illustrating an embodiment of a bonding tool used during gang bonding.
Figure 6B:
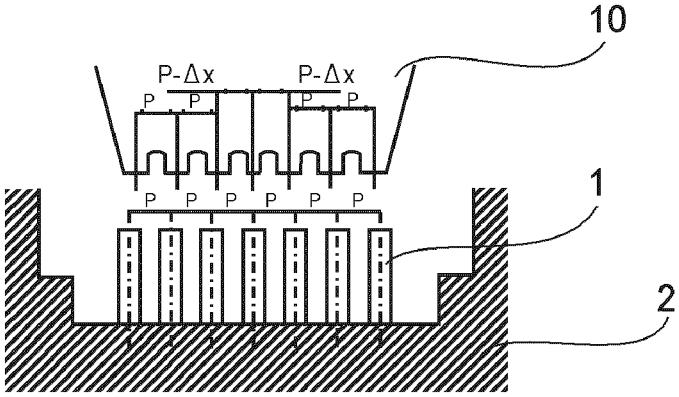

Referring to FIG. 5, the flying leads 1 are provided to the electric wiring member 2 (see also, e.g., FIG. 6B). Further, on the recording element substrate 3 having the energy generating elements 13, the electrical connecting pads 4 are disposed. On each of the flying leads 1, a thermocompression bonding portion 5 is formed during gang bonding of the flying leads 1 of the electric wiring member 2. This thermocompression bonding portion 5 corresponds to a press-contact portion between a free end portion of a bonding tool for thermocompression bonding and an associated flying lead 1.

FIGS. 6A to 6D are schematic views showing an embodiment of the bonding tool used during the gang bonding in this embodiment. FIG. 6A is a perspective view showing the bonding tool 10. FIG. 6B is a schematic view showing a relationship between a pitch of a comb-like free end portion of the bonding tool 10 and a pitch of the flying leads 1.

As shown in FIG. 6B, the free end portion of the bonding tool 10 is formed in a comb-like shape depending on the number of the flying leads 1 of the electric wiring member 2. In the case where an arrangement pitch of the flying leads 1 is taken as P, only a central portion provides a pitch ($P-\Delta x$)

which is smaller than that (P) of other portions by Δx. Further, the central portion of the free end portion of the bonding tool 10 has a width less than those of other portions. As a result, when a center line of the comb-like free end portion of the bonding tool 10 is positionally aligned with a center line of the plurality of arranged flying leads 1, a positional relationship between the bonding tool 10 and the plurality of the flying leads 1 is as follows. That is, as shown in FIG. 6B, each of (tooth) portions other than the central (tooth) portion of the free end portion of the bonding tool 10 is located to satisfy such a positional relationship that it is located inwardly with respect to a corresponding flying lead 1. Here, "inwardly" means that each of portions (other than the central portion of the free end portion of the bonding tool 10) is directed toward the center of the flying leads 1 with respect to the arrangement direction of the flying leads 1, i.e., directed toward a direction indicated by an arrow in FIG. 6D.

The bonding of the flying leads 1 is performed by using and positioning the bonding tool 10 with respect to a front-rear direction and a left-right direction. As a result, with respect to the flying leads 1, the thermocompression bonding portions 5 are formed to locate inwardly.

Figure 6C:
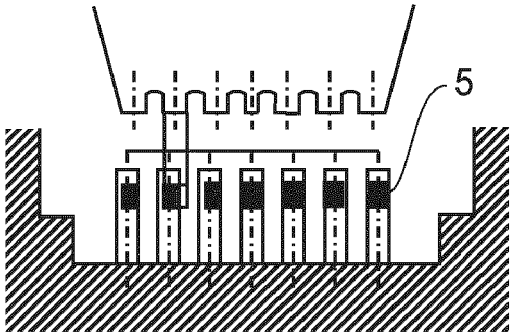
Figure 6D:
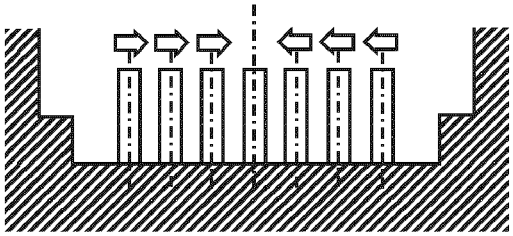

In the case where the number of the flying leads 1 in an odd number as shown in FIGS. 6B to 6D, the central tooth portion of the free end portion of the bonding tool 10 has a width less than those of the flying lead 1, so that a central flying lead 1 is subjected to thermocompression bonding only in a central area thereof corresponding to the central tooth portion of the bonding tool 10.

Figure 7A:
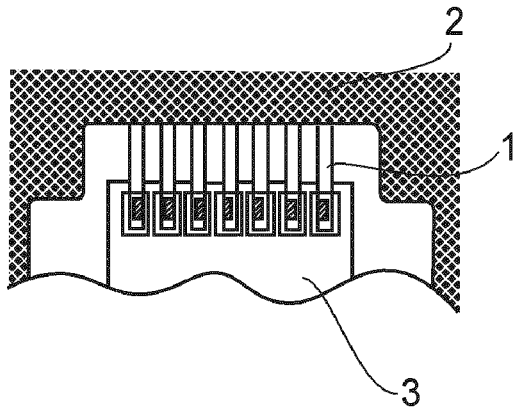
FIGS. 7A to 7D are schematic views for illustrating a force acting on a flying lead when a force is applied to the electric wiring member in an in-plane rotational direction.
Figure 7B:
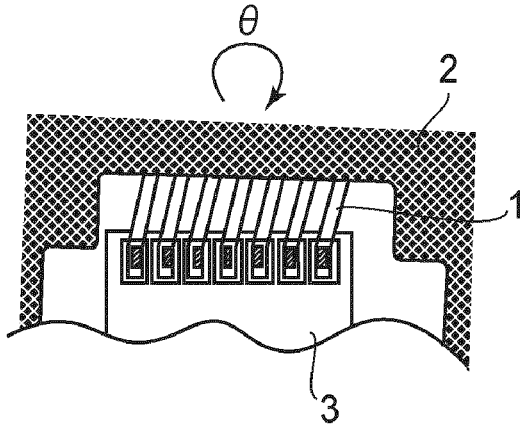

FIGS. 7A to 7D are schematic views for illustrating a force acting on a flying lead when a force is applied to the electric wiring member having flying leads with respect to an in-plane rotational direction. FIG. 7A shows an electrical connecting portion between the electrical connecting pads 4 on the recording element substrate 3 and the flying leads 1 of the electric wiring member 2 after the gang bonding is performed by the above-described bonding tool 10. FIG. 7B shows a state in which a force is applied to the electric wiring member 2 subjected to the gang bonding as shown in FIG. 7A with respect to an in-plane rotational direction θ (clockwise direction in FIG. 7B).

Figure 7C:
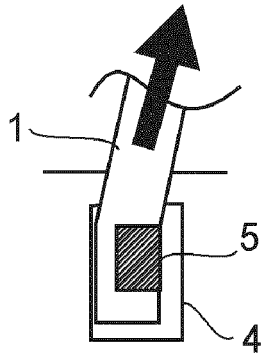

When such a force is applied to the electric wiring member 2, a left end flying lead 1 with respect to the arrangement direction of the flying leads as shown in FIG. 7B is placed in a state in which it is held under tension in an arrow direction indicated in FIG. 7C. At this time, stress concentrates at an outside (left-hand) portion of the flying lead 1 but in this embodiment, the thermocompression bonding portion 5 is not formed at the outside portion, so that an original thickness of the flying lead 1 is retained at the outside portion. For that reason, even when the stress concentration at the outside portion is caused to occur, the left end flying lead 1 is less broken.

Figure 7D:
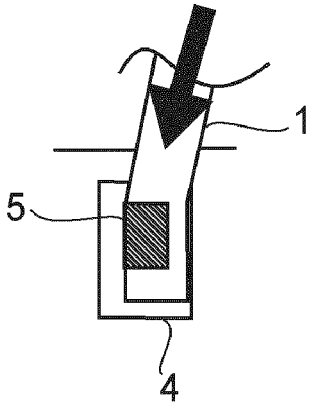

On the other hand, a compressing force indicated by an arrow of FIG. 7D acts on a right end flying lead 1 with respect to the flying lead arrangement direction. However, at this time, the flying lead 1 bends as a whole, so that the compressing force acting on the flying lead 1 is absorbed by the bending. For that reason, the compressing force acting on the flying lead 1 does not concentrate at the thermocompression bonding portion 5, so that the right end flying lead 1 is also less broken.

In this embodiment, on each of the plurality of the flying leads 1, an associated thermocompression bonding portion 5 is formed to locate inwardly, so that the thermocompression bonding portions 5 are symmetrically located with respect to the center line of the plurality of the flying leads with respect to the flying lead arrangement direction. For that reason, even in the case where a force is applied to the electric wiring member 2 with respect to a direction opposite from that (θ) indicated in FIG. 7B<both end flying leads 1 with respect to the flying lead arrangement direction are less broken by the same action as in the case described with reference to FIGS. 7B to 7D.

Figure 8:
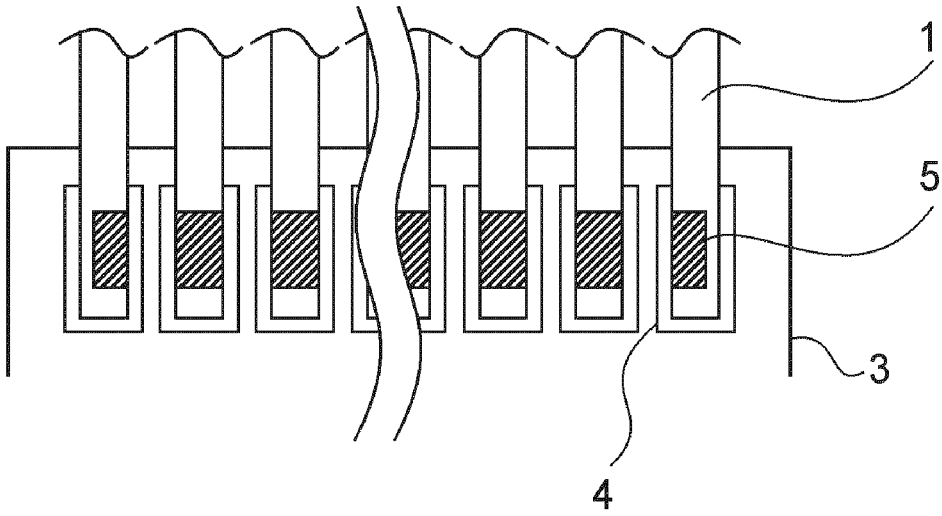
FIG. 8 is a schematic view for illustrating a modified embodiment of First Embodiment.

FIG. 8 shows a modified embodiment of First Embodiment.

In this embodiment, on only both end flying leads 1 of a plurality of flying leads 1, thermocompression bonding portions 5 are formed in a state in which they locate inwardly.

With respect to other flying leads 1, thermocompression bonding portions 5 are formed in a full width of the flying leads 1.

Also in this embodiment, the both end flying leads 1 with respect to the flying lead arrangement direction are less broken even in the case where a force is applied to the electric wiring member 2.

Second Embodiment

Figure 9:
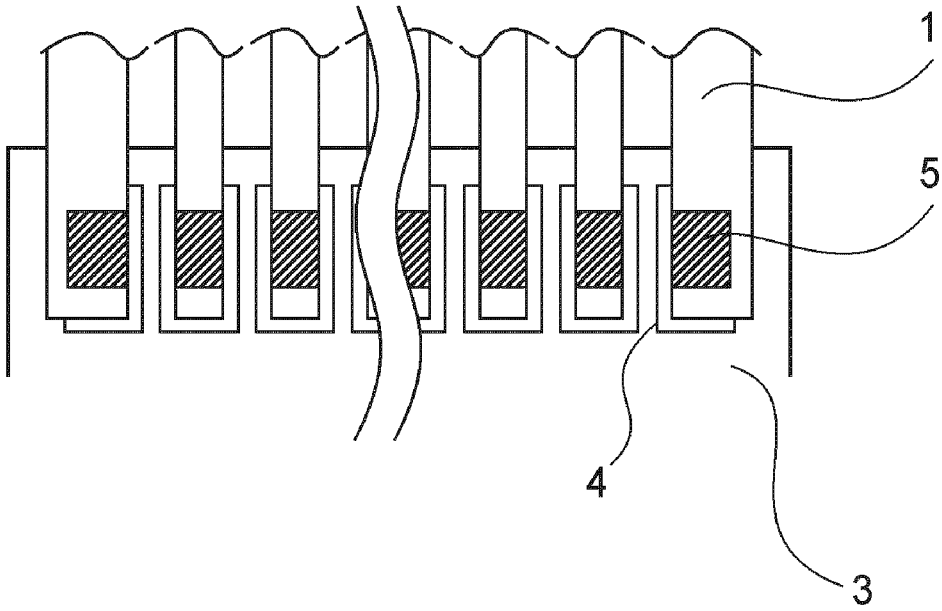
FIG. 9 is a schematic view showing an electrical connecting portion between electrical connecting pads on a recording element substrate and flying leads of an electric wiring member in Second Embodiment of the present invention.

FIG. 9 is a schematic view showing an electrical connecting portion between electrical connecting pads 4 on a recording element substrate 3 and flying leads 1 of an electric wiring member 2 in this embodiment.

In the case where the flying leads 1 are required to be connected to the electrical connecting pads 4 on the recording element substrate 3 with a high density, a width of each of flying leads 1 has to be decreased as shown in FIG. 9. In this case, when all the thermocompression bonding portion 5 are inwardly located with respect to the flying leads 1 as shown in FIG. 5, there is a possibility that a sufficient bonding strength for thermocompression bonding is not obtained.

In view of this possibility in this embodiment, both end flying leads 1 with respect to the arrangement direction of the plurality of flying leads are formed in a width move than those of other flying leads 1. By this, on the arrangement direction both end flying leads 1, a wider area for an associated thermocompression bonding portion 5 is ensured compared with the case of other flying leads 1. Incidentally, the electrical connecting pads 4 on the recording element substrate 3 may have the same dimension with respect to all the flying leads 1.

According to this embodiment, it is possible to enhance not only a wiring density by decreasing the width of the flying leads 1 but also reliability of a bonding connection portion by increasing the width of the thermocompression bonding portions 5 on the both end flying leads compared with those of the thermocompression bonding portions 5 on other flying leads 1.

Figure 10:
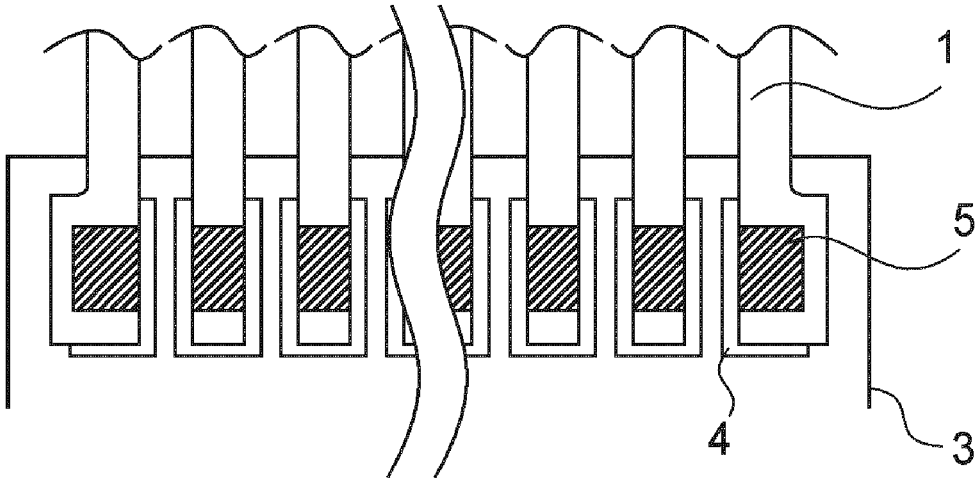
FIG. 10 is a schematic view for illustrating a modified embodiment of Second Embodiment.
Figures 11A, 11B:
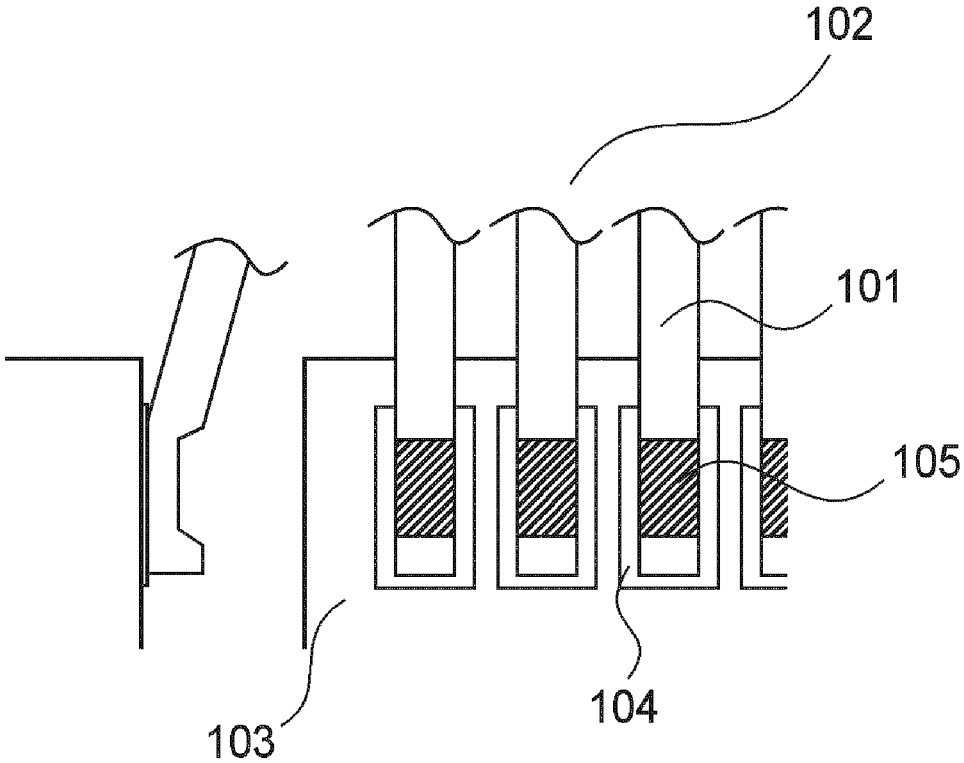
FIGS. 11A and 11B are schematic views showing an electrical connecting portion between electrical connecting pads on a recording element substrate and flying leads of an electric wiring member in a conventional ink jet head.
Figure 12A:
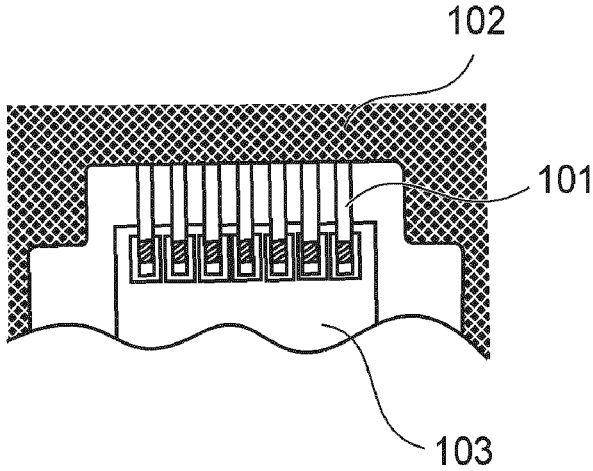
FIGS. 12A to 12D are schematic views for illustrating a state of breaking of a flying lead when a force is applied to a conventional electric wiring member having flying leads in an in-plane rotational direction.
Figure 12B:
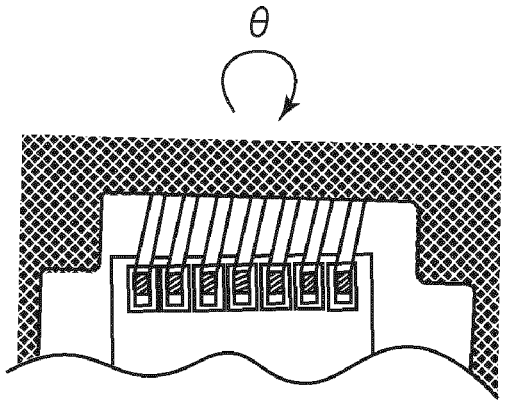
Figure 12C:
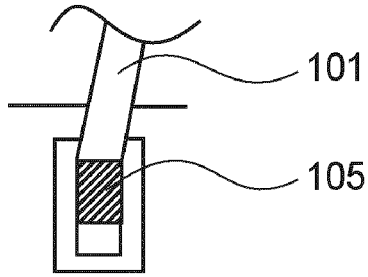
Figure 12D:
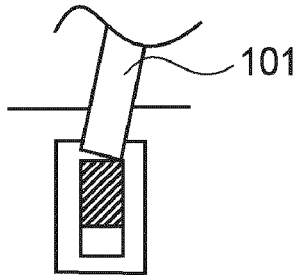

FIG. 10 is a schematic view showing a modified embodiment of Second Embodiment.

In this embodiment, a constitution shown in FIG. 10 is the same as that shown in FIG. 9 except that both end flying leads 1 are formed in such a shape that each of the both end flying leads 1 has a partly wider area in which a thermocompression bonding portion 5 and its adjacent portion are located. According to this modified embodiment, it is possible to enhance a bonding strength of the arrangement direction both end flying leads 1 similarly as in Second Embodiment. In addition, it is possible to ensure the same width with respect to all the flying leads except for the portions having the wider area.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 163706/2007 filed Jun. 21, 2007, which is hereby incorporated by reference.

What is claimed is:

1. An ink jet head comprising:

a recording element substrate comprising an energy generating element; and an electric wiring member on which a plurality of flying leads electrically connected to said recording element substrate by thermocompression bonding through gang bonding is arranged in parallel, wherein said ink jet head comprises a plurality of thermocompression bonding portions, formed on the plurality of flying leads by the thermocompression bonding, including thermocompression bonding portions formed on at least both end flying leads with respect to an arrangement direction of the plurality of flying leads, and wherein the thermocompression bonding portions formed on said at least both end flying leads are offset toward a center of the plurality of flying leads with respect to the arrangement direction.

2. A head according to claim 1, wherein both end flying leads with respect to the arrangement direction have a width more than that of other flying leads, and wherein only thermocompression bonding portions formed on the both end flying leads are located toward the center of the plurality of flying leads.

3. A head according to claim 2, wherein the both end flying leads with respect to the arrangement direction have a width more than that of other flying leads only at a portion on which an associated thermocompression bonding is formed.

4. A head according to claim 1, wherein thermocompression bonding portions excluding a thermocompression bonding portion formed on a center flying lead with respect to the arrangement direction are located toward the center flying lead.

* * * * *